US010780556B2

(12) United States Patent
Kukucka et al.

(10) Patent No.: US 10,780,556 B2
(45) Date of Patent: Sep. 22, 2020

(54) ANTI-SLIP, MULTIDIRECTIONAL DRIVER BIT

(71) Applicant: Grip Tooling Technologies LLC, Brandon, FL (US)

(72) Inventors: Paul Kukucka, Brandon, FL (US); Thomas Stefan Kukucka, Brandon, FL (US)

(73) Assignee: Grip Tooling Technologies LLC, Brandon, FL (US)

( * ) Notice: Subject to any disclaimer, the term of this patent is extended or adjusted under 35 U.S.C. 154(b) by 3 days.

(21) Appl. No.: 16/107,842

(22) Filed: Aug. 21, 2018

(65) Prior Publication Data

US 2018/0354102 A1 Dec. 13, 2018

Related U.S. Application Data

(63) Continuation-in-part of application No. 14/701,482, filed on Apr. 30, 2015, now abandoned, and a (Continued)

(51) Int. Cl.
*B25B 15/00* (2006.01)
*B25B 27/18* (2006.01)
(Continued)

(52) U.S. Cl.
CPC ..... *B25B 15/004* (2013.01); *B25B 13/04* (2013.01); *B25B 13/065* (2013.01); (Continued)

(58) Field of Classification Search
CPC ... B25B 15/001; B25B 15/004; B25B 15/005; B25B 23/28; B25B 27/18; B25B 13/04; (Continued)

(56) References Cited

U.S. PATENT DOCUMENTS 8,984,991 B1 * 3/2015 English ..... B25B 13/481 81/121.1
D776,505 S 1/2017 Doroslovac
(Continued)

FOREIGN PATENT DOCUMENTS

WO WO-2010007402 A1 * 1/2010 ..... B25B 13/488

*Primary Examiner* — Monica S Carter
*Assistant Examiner* — Abbie E Quann

(57) ABSTRACT

A screw bit body which allows for efficient torque force application onto a socket fastener. The screw bit body includes a plurality of laterally-bracing sidewalls, a first base, and a second base. The laterally-bracing sidewalls are radially distributed about a rotation axis of the screw bit body with each further including a first lateral edge, a second lateral edge, a bracing surface, and an engagement cavity. The engagement cavity creates an additional gripping point to prevent slippage in between the screw bit body and the socket fastener. The engagement cavity traverses normal and into the bracing surface. Additionally, the engagement cavity traverses into the screw bit body from the first base to the second base. The engagement cavity is specifically positioned offset from the first lateral edge by a first distance.

9 Claims, 14 Drawing Sheets

Related U.S. Application Data continuation-in-part of application No. 15/601,864, filed on May 22, 2017, now abandoned, and a continuation-in-part of application No. PCT/IB2017/052453, filed on Apr. 27, 2017, application No. 16/107,842, which is a continuation-in-part of application No. 29/592,608, filed on Jan. 31, 2017, now abandoned, and a continuation-in-part of application No. 29/604,799, filed on May 19, 2017, now Pat. No. Des. 829,069, and a continuation-in-part of application No. 15/650,768, filed on Jul. 14, 2017, now Pat. No. 10,081,094.

(60) Provisional application No. 62/664,559, filed on Apr. 30, 2018, provisional application No. 62/531,828, filed on Jul. 12, 2017, provisional application No. 62/482,916, filed on Apr. 7, 2017, provisional application No. 62/475,757, filed on Mar. 23, 2017, provisional application No. 62/459,371, filed on Feb. 15, 2017, provisional application No. 62/451,491, filed on Jan. 27, 2017, provisional application No. 62/328,102, filed on Apr. 27, 2016, provisional application No. 61/986,327, filed on Apr. 30, 2014.

(51) Int. Cl.

| | |
|---|---|
| ***B25B 13/04*** | (2006.01) |
| ***B25B 13/06*** | (2006.01) |
| ***B25B 23/08*** | (2006.01) |

(52) U.S. Cl.

CPC ..... *B25B 15/001* (2013.01); *B25B 15/008* (2013.01); *B25B 23/08* (2013.01); *B25B 27/18* (2013.01)

(58) Field of Classification Search

CPC .... B23D 77/00; B23D 2277/20; B27G 13/00; B27G 13/002; B27G 13/02; B27G 13/08

USPC ..... 81/461, 179, 177.75, 53.2

See application file for complete search history.

(56) References Cited

U.S. PATENT DOCUMENTS

| | | | | |
|---|---|---|---|---|
| 9,687,968 | B2 | 1/2017 | Doroslovac et al. | |
| D784,106 | S | 4/2017 | Doroslovac | |
| D794,405 | S | 8/2017 | Doroslovac et al. | |
| D798,682 | S | 10/2017 | Doroslovac et al. | |
| 2006/0266168 | A1* | 11/2006 | Pacheco, Jr. ..... | B25B 15/005 81/460 |
| 2013/0340578 | A1* | 12/2013 | Lai ..... | B25B 15/005 81/460 |
| 2014/0260832 | A1* | 9/2014 | Hsiao ..... | B25B 23/0035 81/438 |
| 2015/0266169 | A1* | 9/2015 | Campbell, II ..... | B21K 1/463 81/436 |
| 2018/0003241 | A1* | 1/2018 | Goss ..... | F16B 23/003 |

* cited by examiner

ANTI-SLIP, MULTIDIRECTIONAL DRIVER BIT

FIELD OF THE INVENTION

The present invention generally relates to various tools designed for tightening or loosening fasteners, in particular bolts and nuts. More specifically, the present invention is an anti-slip multidirectional driver bit, designed to prevent damaging or stripping fasteners during the extraction or tightening process.

BACKGROUND OF THE INVENTION

Hex bolts, nuts, screws, and other similar threaded devices are used to secure and hold multiple components together by being engaged to a complimentary thread, known as a female thread. The general structure of these types of fasteners is a cylindrical shaft with an external thread and a head at one end of the shaft. The external thread engages a complimentary female thread tapped into a hole or a nut and secures the fastener in place, fastening the associated components together. The head receives an external torque force and is the means by which the fastener is turned, or driven, into the female threading. The head is shaped specifically to allow an external tool like a wrench to apply a torque to the fastener in order to rotate the fastener and engage the complimentary female threading to a certain degree. This type of fastener is simple, extremely effective, cheap, and highly popular in modern construction.

One of the most common problems in using these types of fasteners, whether male or female, is the tool slipping in the head portion, or slipping on the head portion. This is generally caused by either a worn fastener or tool, corrosion, overtightening, or damage to the head portion of the fastener. The present invention is a driving bit design that virtually eliminates slippage. The design uses a series of segmented portions that bite into the head of the fastener and allow for efficient torque transfer between the driving bit and the head portion of the fastener. The present invention eliminates the need for the common bolt extractors as they require unnecessary drilling and tools. With the development of electric screwdrivers, and drills, people have been using, power tools to apply the required torsional forces and remove various fasteners. The present invention provides a double-sided driver end bit, thus allowing for torque to applied to the fastener in both clockwise and counterclockwise directions, thus tightening or loosening the fastener. Most driver end bits have a standardized one fourth inch hex holder and come in various configurations including but not limited to, square end, hex end, or star end.

DETAIL DESCRIPTIONS OF THE INVENTION

All illustrations of the drawings are for the purpose of describing selected versions of the present invention and are not intended to limit the scope of the present invention.

The present invention generally related to torque tool accessories. More specifically, the present invention is a multi-grip screw bit, also known as a screw bit or driver. The present invention allows for a higher torque to be applied to a fastener than a similarly sized conventional driver bit without damaging the head of the fastener or the bit tool. This is achieved through the use of a multitude of engagement features which effectively grip the head of the fastener. The present invention is a screw bit that is compatible with a variety of torque tools including, but not limited to, traditional drills, bit-receiving screwdrivers, socket wrenches, and socket drivers.

Figure 1:
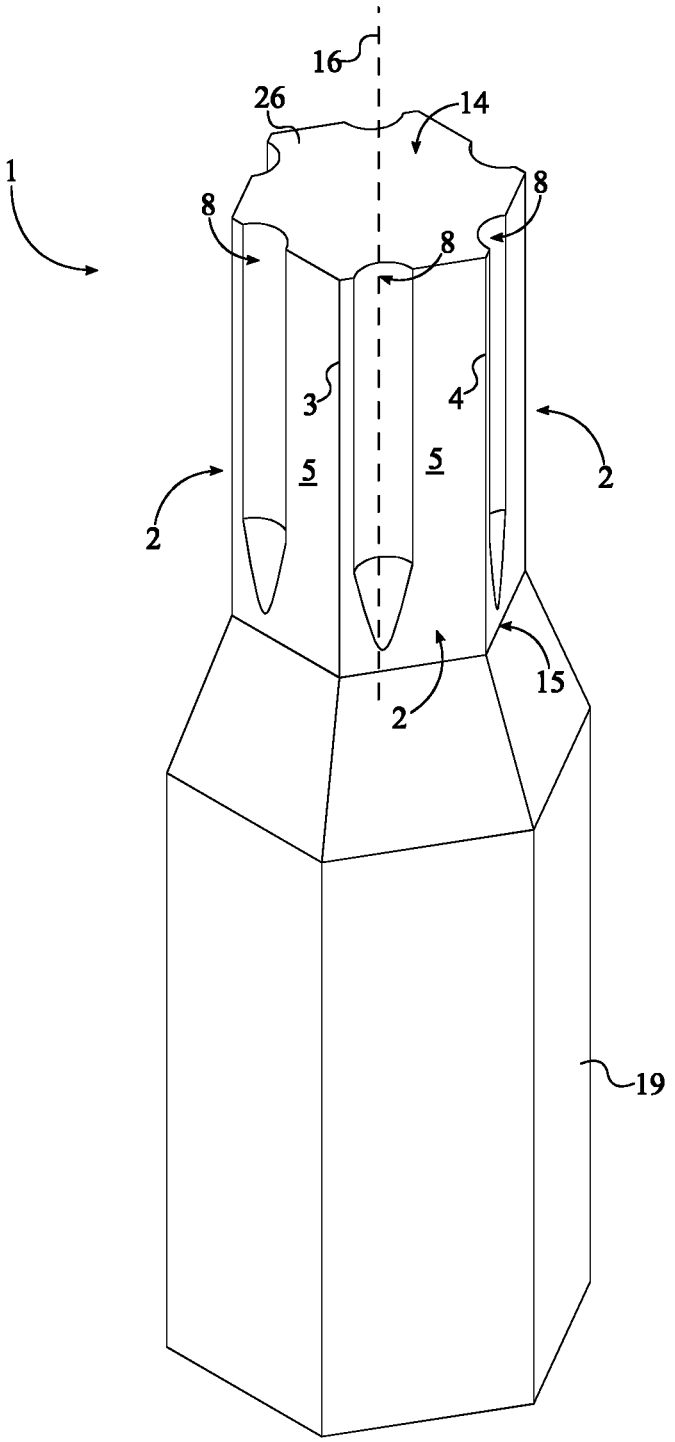
FIG. 1 is a perspective view of the present invention.

In its simplest embodiment, referring to FIG. 1, the present invention comprises an at least one screw bit body 1 and an attachment body 19. The screw bit body 1 is a shank which engages the socket fastener, such as a socket screw or a socket bolt, in order to apply a torque force onto the socket faster. The screw bit body 1 comprises a plurality of laterally-bracing sidewalls 2, a first base 14, and a second base 15. In general, the screw bit body 1 is a prism composed of a strong metal. Each of the plurality of laterally-bracing sidewalls 2 engage within and grip the socket fastener in order to efficiently transfer torque from a torque tool to the socket fastener. The first base 14 and the second base 15 are positioned opposite to each other along the plurality of laterally-bracing sidewalls 2. Additionally, the first base 14, and thus second base 15, is preferably oriented perpendicular to each of the plurality of laterally-bracing sidewalls and thus enclose/complete the prism shape of the screw bit body 1. More specifically, it is preferred that the first base 14 comprises a first base surface 26, wherein the first base surface 26 is flat and is oriented perpendicular to the bracing surface 5 of each of the plurality of laterally-bracing sidewalls 2.

The attachment body 19 allows the present invention to be attached to an external torque tool and, thus, allow torque force to be applied to the socket fastener through the screw bit body 1. The attachment body 19 is centrally positioned around and along a rotation axis 16 of the screw bit body 1 such that the rotation axis of the attachment body 19 and the rotation axis 16 of the screw bit body 1 are coincidentally aligned. Additionally, the attachment body 19 is connected adjacent to the second base 15. The attachment body 19 preferably has a hexagonal cross-section in order to fit within a female attachment member of the external torque tool. External torque tools include, but are not limited to, electric drills, torque wrenches, pneumatic drills, socket screw drivers, and other similar torque tools.

Figure 3:
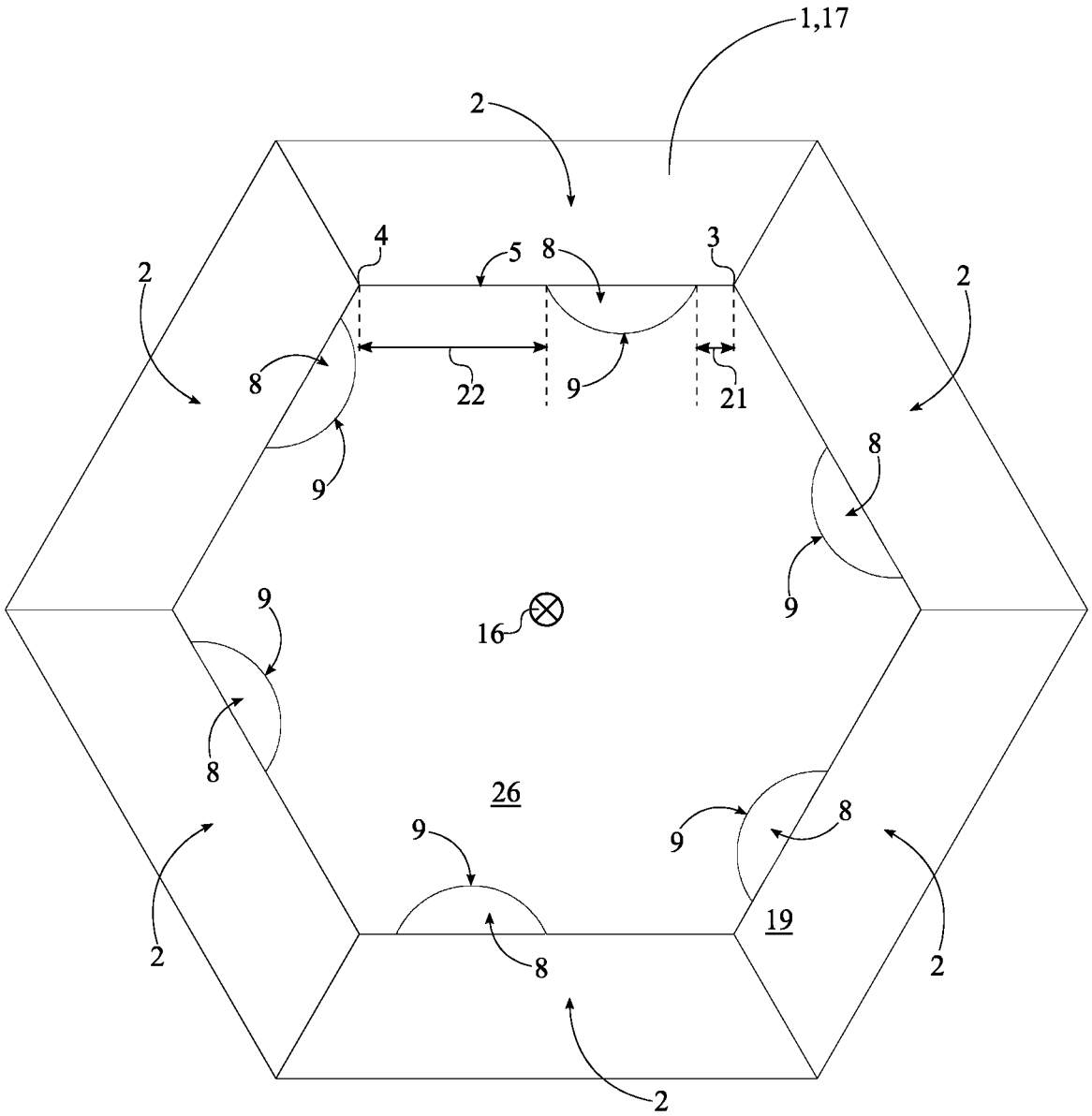
FIG. 3 is a front view of the alternative embodiment of the present invention in FIG. 2.
Figure 4:
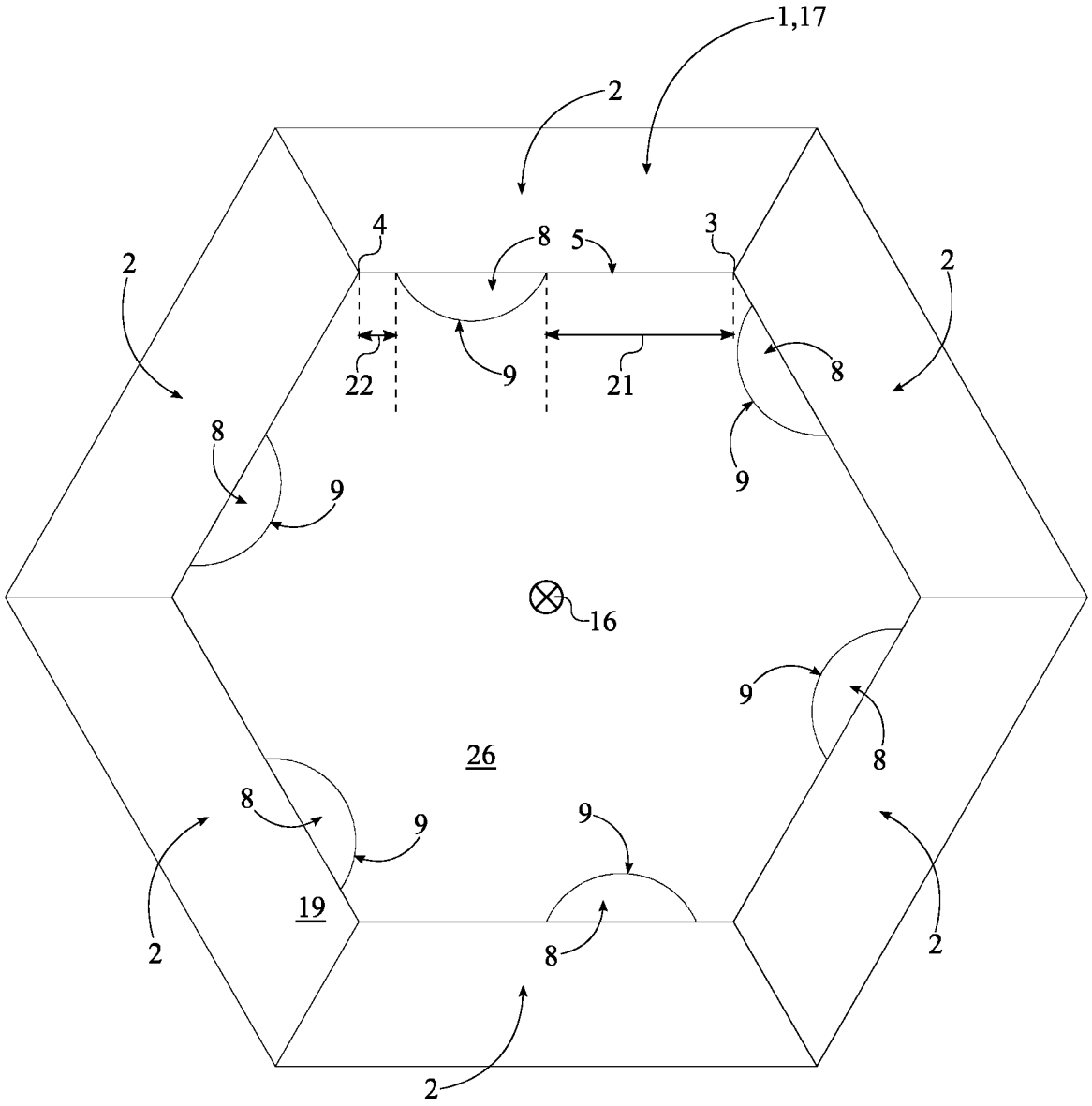
FIG. 4 is a rear view of the alternative embodiment of the present invention in FIG. 2.

Referring to FIG. 3 and FIG. 4, each of the laterally-bracing sidewalls comprises a first lateral edge 3, a second lateral edge 4, a bracing surface 5, and an at least one engagement cavity 8. The plurality of laterally-bracing sidewalls 2 is radially positioned about the rotation axis 16 of the screw bit body 1 in order to yield a geometric profile complimentary to that of the socket fastener. The number within the plurality of laterally-bracing sidewalls 2 is subject to change to compliment the shape and profile of a variety of socket fasteners. In one embodiment of the present invention, the number within the plurality of laterally-bracing sidewalls 2 is six and the resulting geometric profile of the screw bit body 1 is a hexagon. In an alternative embodiment of the present invention, the number within the plurality of laterally-bracing sidewalls 2 is four.

Figure 11:
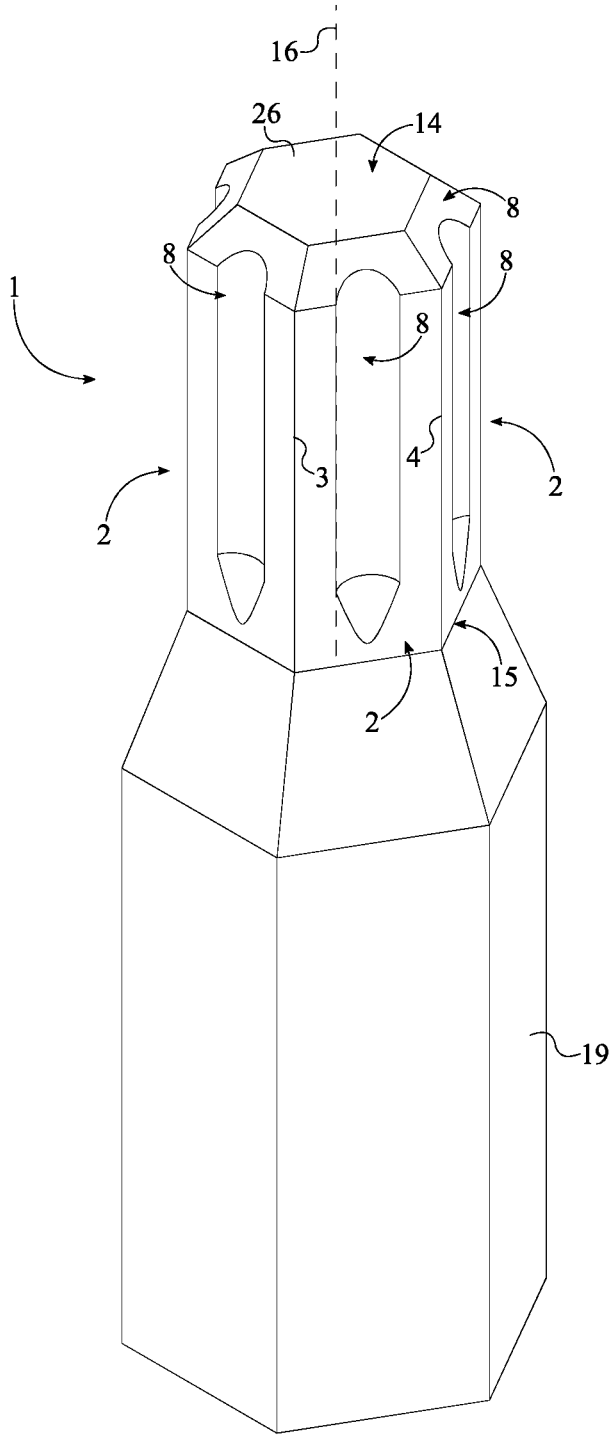
FIG. 11 is a perspective view of an alternative embodiment of the present invention.
Figure 13:
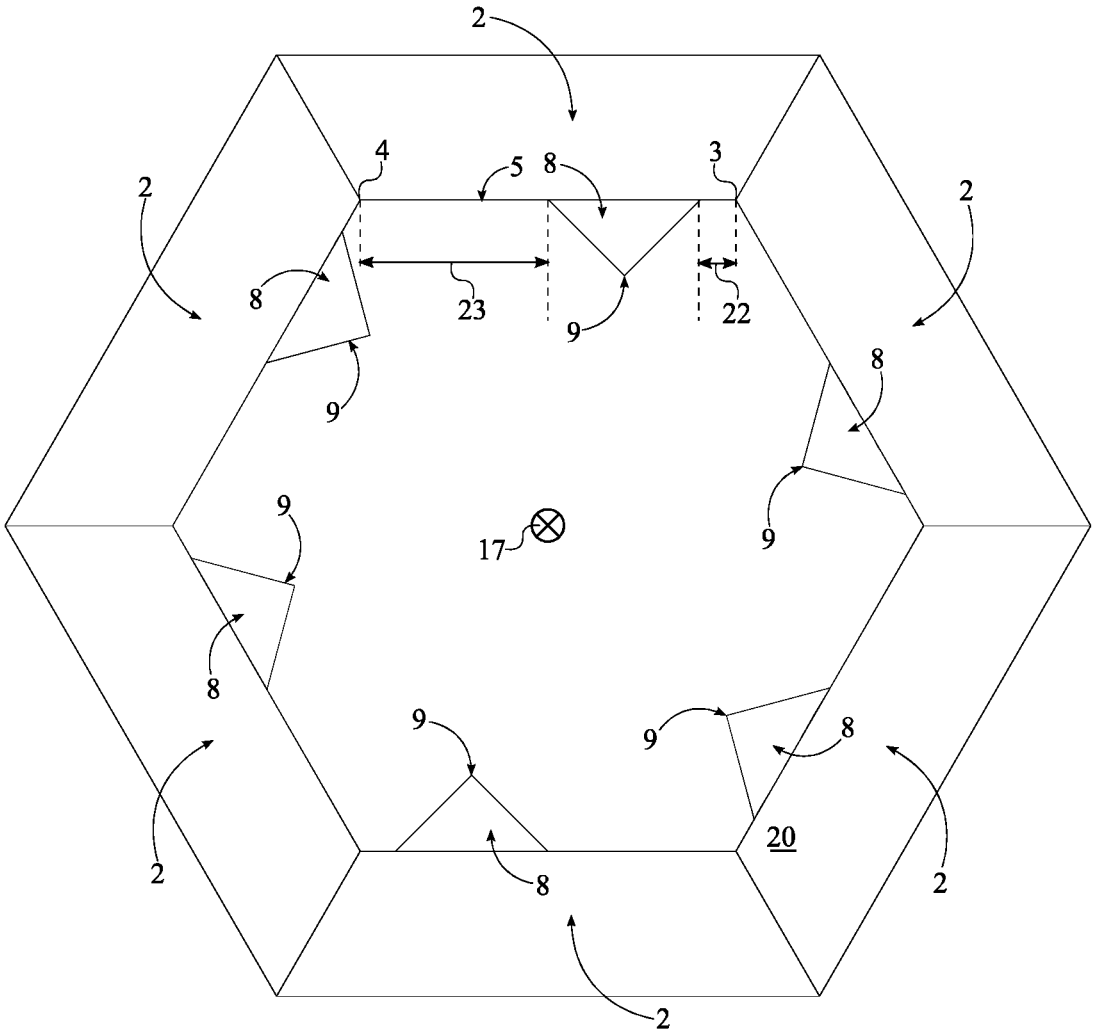
FIG. 13 is a front view of a separate alternative embodiment of the present invention in FIG. 2 where an entire cross-section of the engagement cavity as a triangular profile.
Figure 14:
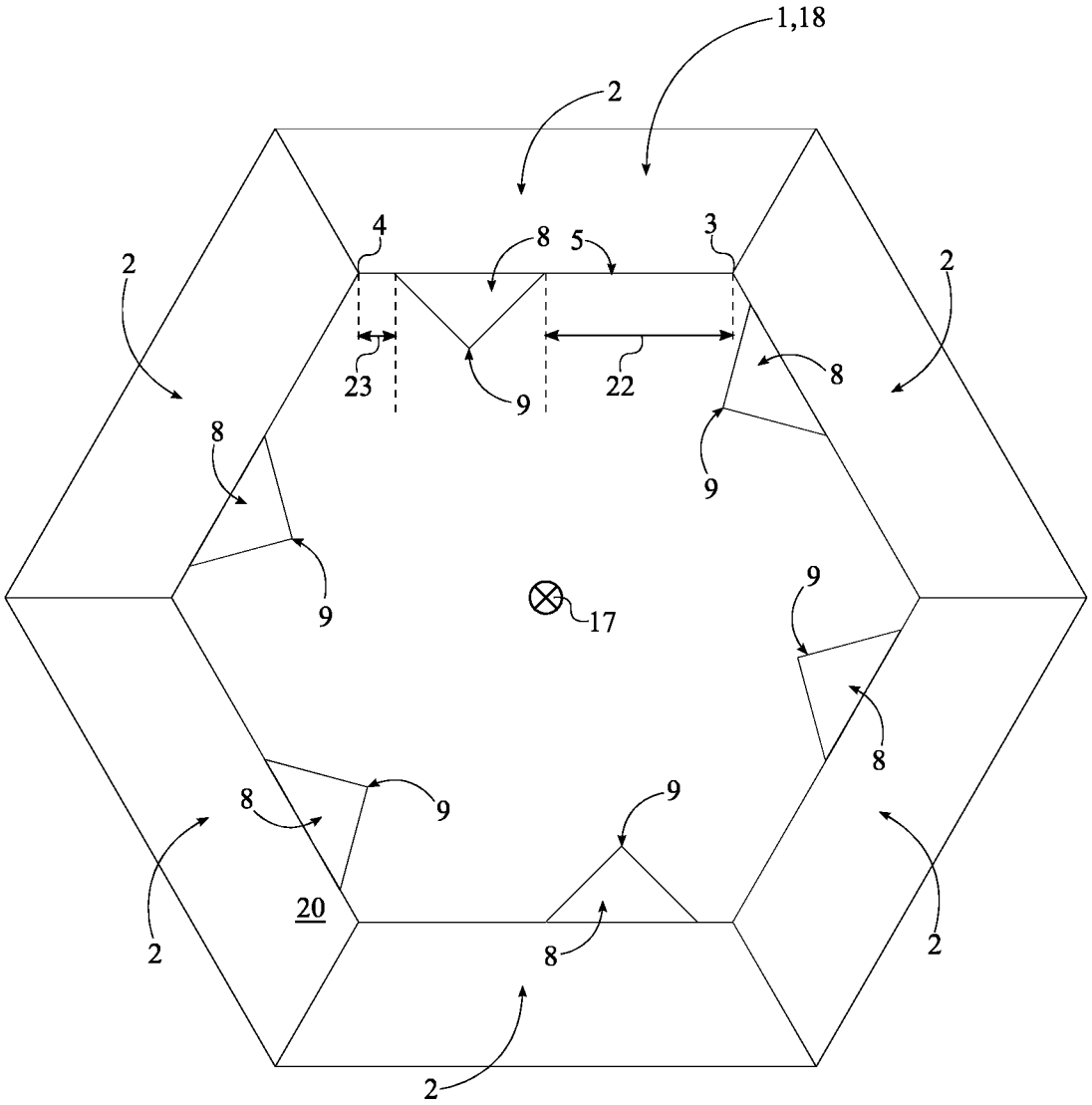
FIG. 14 is a rear view of the separate alternative embodiment of the present invention in FIG. 2 where an entire cross-section of the engagement cavity as a triangular profile.

The bracing surface 5 physically presses against the socket fastener, specifically against the lateral sidewall of a head portion from the socket fastener. The first lateral edge 3 and the second lateral edge 4 are positioned opposite to each other across the bracing surface 5. When viewed from either the top perspective or the bottom perspective, the first lateral edge 3 and the second lateral edge 4 from each of the plurality of laterally-bracing sidewalls 2 make up the corners of the screw bit body 1. The engagement cavity 8 extends normal and into the bracing surface 5 and creates an additional gripping point/tooth on the bracing surface 5. Additionally, the engagement cavity 8 is positioned offset from the first lateral edge 3 by a first distance 21. Resultantly, the gripping point is created by the engagement cavity 8 and the bracing surface 5. In another embodiment, the gripping point is created by the engagement cavity 8 and an adjacent edge, wherein the adjacent edge is either the first lateral edge 3 or the second lateral edge 4; in particular, the adjacent edge is the edge closest to the engagement cavity 8. Additionally, the engagement cavity 8 extends into the screw bit body 1 from the first base 14 towards the second base 15. This ensures that the additional gripping point extends along the length of the screw bit body 1 for maximum grip engagement between the screw bit body 1 and the socket fastener. To further accomplish this, it is preferred that an entire cross-section 9 of the engagement cavity 8 is parallel to the first base 14 and the second base 15. In one embodiment of the present invention, the engagement cavity 8 also tapers from the first base 14 to the second base 15 as seen in FIG. 11. Referring to FIG. 3, in one embodiment of the present invention, the entire cross-section 9 of the engagement cavity 8 is a partially-circular profile. Additionally, the partially-circular profile is concave along a direction from the first lateral edge 3 to the second lateral edge 4. The partially-circular profile ensures that there are little to no high stress points in the screw bit body 1, thus increasing the overall longevity of the tool. Referring to FIG. 13 and FIG. 14, in a separate embodiment of the present invention, the entire cross-section 9 of the engagement cavity 8 is a triangular profile. Additionally, the triangular profile is concave along a direction from the first lateral edge 3 to the second lateral edge 4. Alternative profiles may be used for the engagement cavity 8 including, but not limited to, a semi-square profile, a semi-rectangular profile, and a semi-oval profile.

Figure 8:
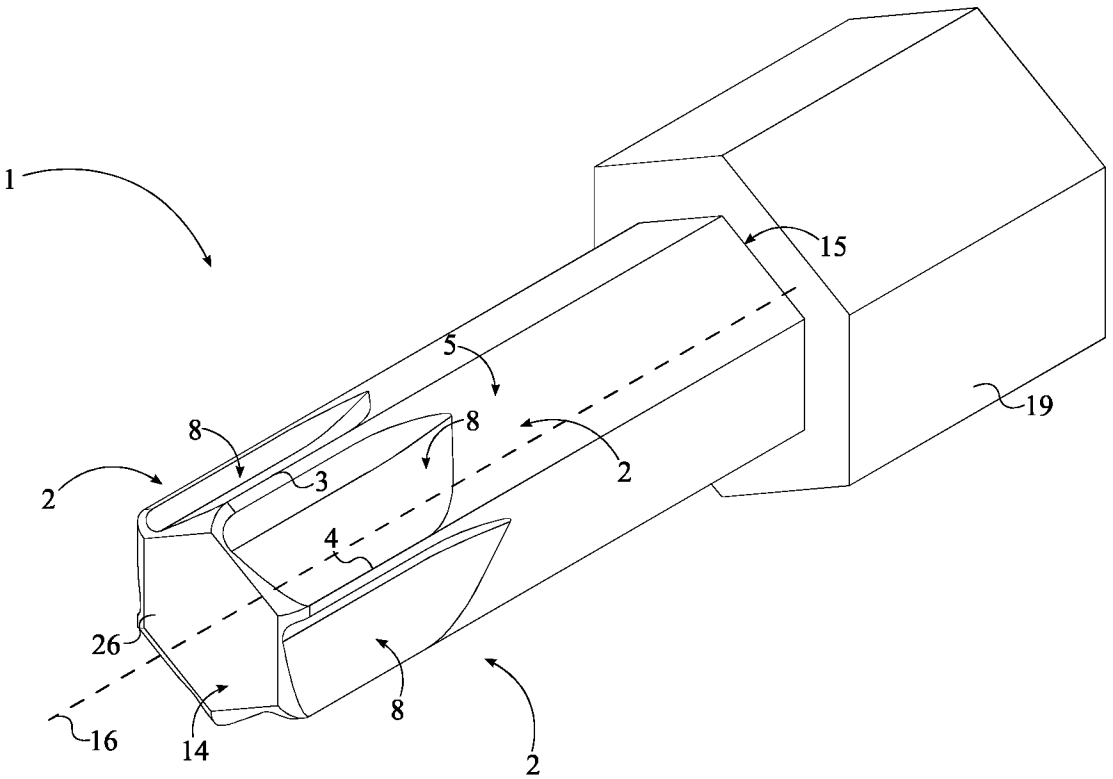
FIG. 8 is a perspective view of an alternative embodiment of the present invention.
Figure 9:
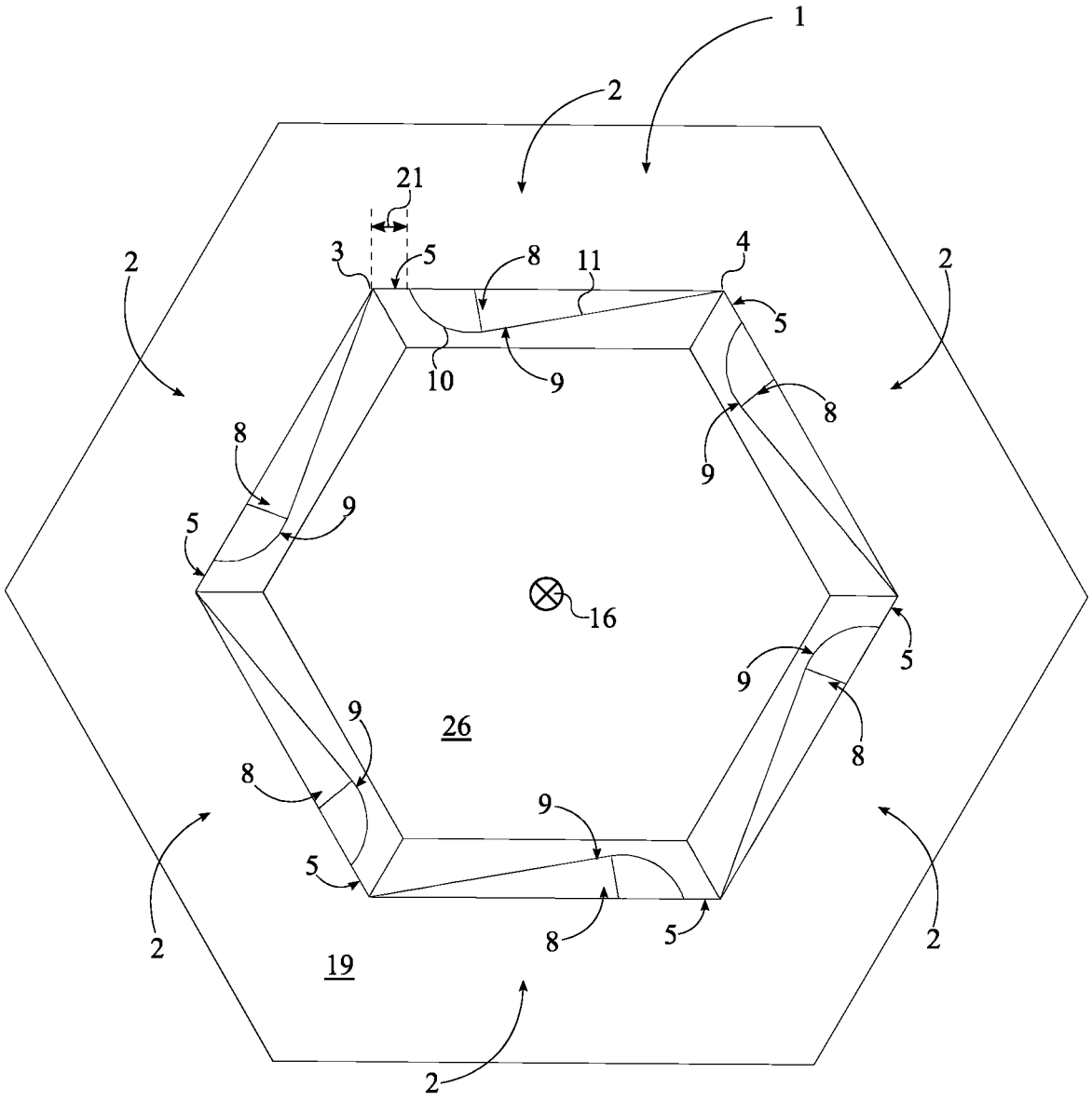
FIG. 9 is a front view of the alternative embodiment of the present invention in FIG. 8.

In one embodiment of the present invention, referring to FIG. 8 and FIG. 9, the entire cross-section 9 of the engagement cavity 8 comprises a curved portion 10 and a straight portion 11. In this embodiment, the present invention is implemented as an extraction bit, wherein the present invention is designed to extract damaged or broken fasteners, damaged rods, broken studs, and other similar items. The engagement cavity 8 is uniquely shaped in order to form a sharp engagement tooth that grips in the corners of the socket fastener, allowing material from the internal sides of the fastener socket into the engagement cavity 8 and thus yielding a superior grip over traditional tools which are simply designed to push material away. This is especially true for worn or damaged fastener socket. More specifically, the curved portion 10 is a semi-circular curve that is positioned adjacent to the first lateral edge 3. The straight portion 11 is positioned adjacent to the curved portion 10, opposite the first lateral edge 3. The straight portion 11 guides a portion of the socket fastener to press against the engagement tooth. As such, the straight portion 11 extends from the curved portion 10 to the second lateral edge 4. Specifically, the straight portion 11 starts at the curved portion 10 and ends at the second lateral edge 4.

In another embodiment of the present invention, referring to FIG. 11, the engagement cavity 8 is centrally position on the bracing surface 5. In particular, the engagement cavity 8 is positioned offset from the second lateral edge 4 by a second distance 22. For central positioning, the first distance 21 is equal to the second distance 22. This positions the engagement cavity 8 to engage the internal lateral sidewall of the socket fastener for the most efficient transfer of torque with the least possibility of slippage. Additionally, this embodiment may be used to rotate the socket fastener in either the clockwise or the counter-clockwise direction.

In another embodiment of the present invention, the proportion between the first distance 21, the second distance 22, and the width of the engagement cavity 8 may be altered in order to achieve a dedicated clockwise or counterclockwise design. In one embodiment, the present invention is configured to be a clockwise drive bit. For this embodiment, the first distance 21 is greater than the second distance 22. In particular, the proportion between the first distance 21, the second distance 22, and the width of the engagement cavity 8 is 1:5:4, thus yielding a design of the present invention which grips and applies torque to the socket fastener in the clockwise direction. This design is used to screw in and secure the socket fastener. In another embodiment, the present invention is configured to be a counter-clockwise screw bit. For this embodiment, the first distance 21 is greater than the second distance 22. In particular, the proportion between the first distance 21, the second distance 22, and the width of the engagement cavity 8 is 5:1:4, thus yielding a design which grips and applies torque to the socket fastener in the counter-clockwise direction. This design is used to release and extract the socket fastener.

Figure 10:
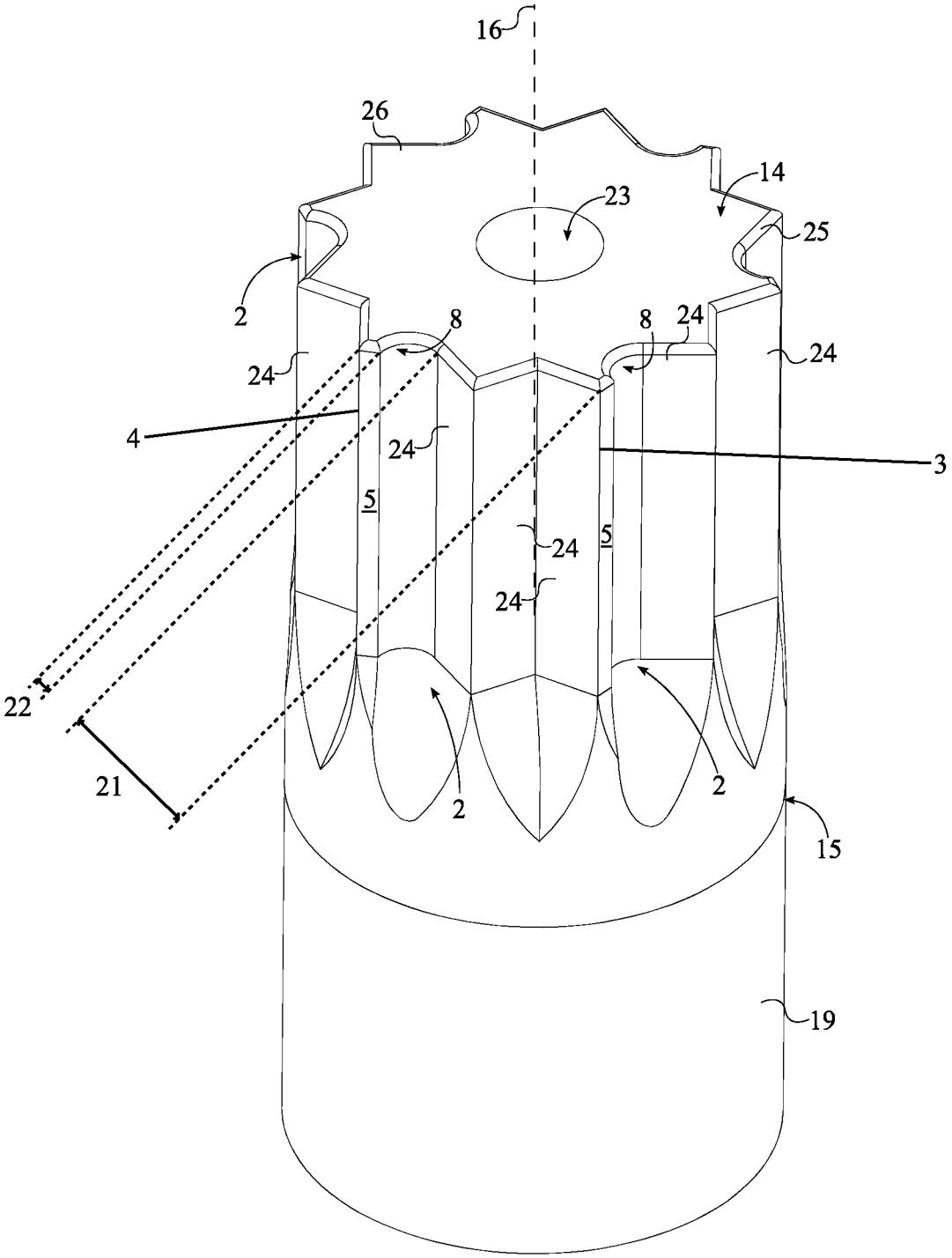
FIG. 10 is a perspective view of an alternative embodiment of the present invention.

Referring to FIG. 10, the present invention may also be implemented in a spline/square bit design. In this embodiment, the screw bit body 1 is a spline-type bit body that transfers torque to the socket fastener through a multitude of protrusions. Specifically, the screw bit body 1 further comprises a plurality of intermittent sidewalls 24. Each of the plurality of intermittent sidewalls 24 is a flat surface which engages the socket fastener like a traditional screw bit design. The plurality of intermittent sidewalls 24 is radially positioned about the rotation axis 16. Additionally, the plurality of intermittent sidewalls 24 is interspersed amongst the plurality of laterally-bracing sidewalls 2. The ratio between the plurality of laterally-bracing sidewalls 2 and the plurality of intermittent sidewalls 24 is subject to change to yield a variety of different screw bit designs. In one embodiment, the plurality of intermittent sidewalls 24 and the plurality of laterally-bracing sidewalls 2 radially alternate between each other. In another embodiment, there are three sidewalls from the plurality of intermittent sidewalls 24 in between each of the plurality of laterally-bracing sidewalls 2. Resultantly, this configuration places an engagement feature/tooth at every other protrusion of the screw bit body 1.

Figure 6:
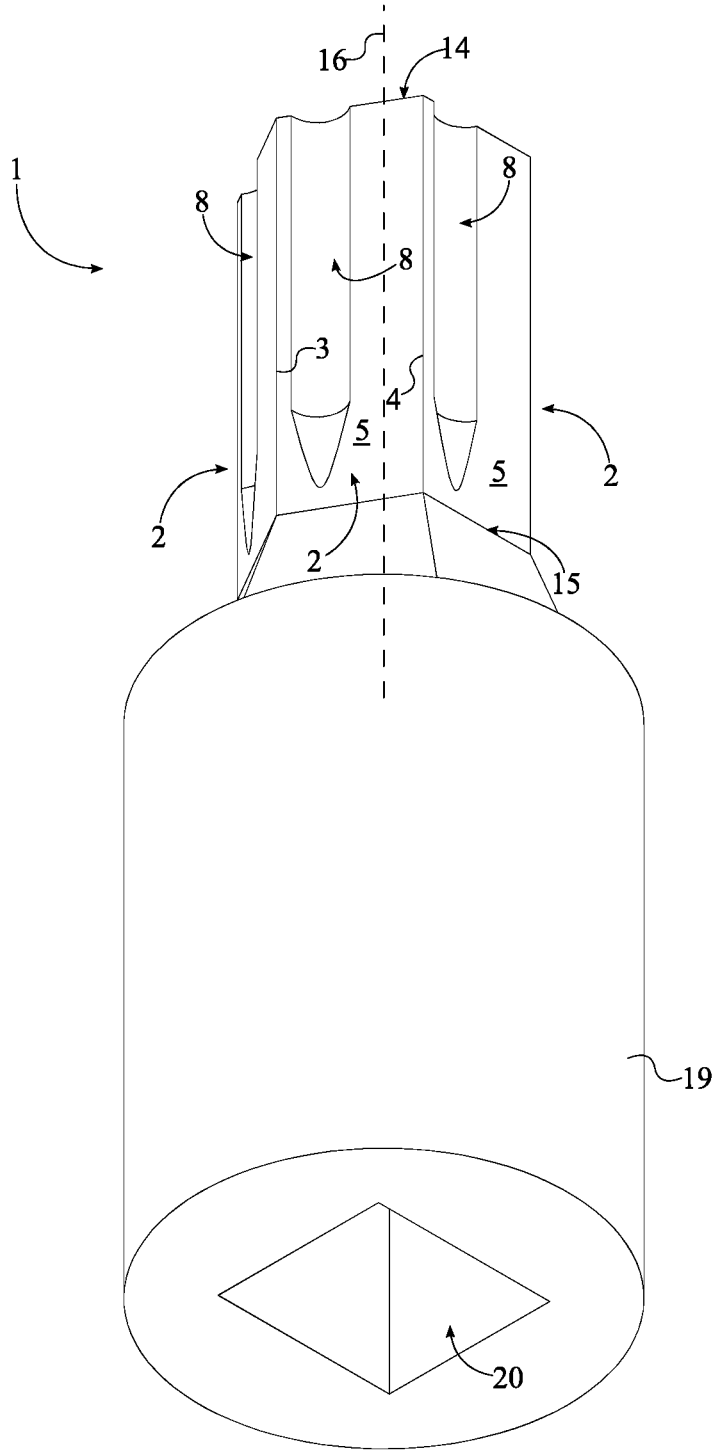
FIG. 6 is a bottom perspective of the present invention.

In another embodiment, referring to FIG. 6, the present invention further comprises an engagement bore 20. The engagement bore 20 allows the present invention to be attached to a male attachment member of an external torque tool, such as a socket wrench or a screw driver. The engagement bore 20 extends into the attachment body 19 along the rotation axis, opposite the screw bit body 1. The engagement bore 20 is shaped to receive a male attachment member of a socket wrench; the preferred shape is square as the majority of socket wrenches utilize a square attachment member. In this embodiment, the preferred attachment body 19 is cylindrical shaped. In alternative embodiments, the shape and design of the engagement bore 20 and the attachment body 19 may vary to be adaptable to different torque tool designs and different attachment means.

Figure 2:
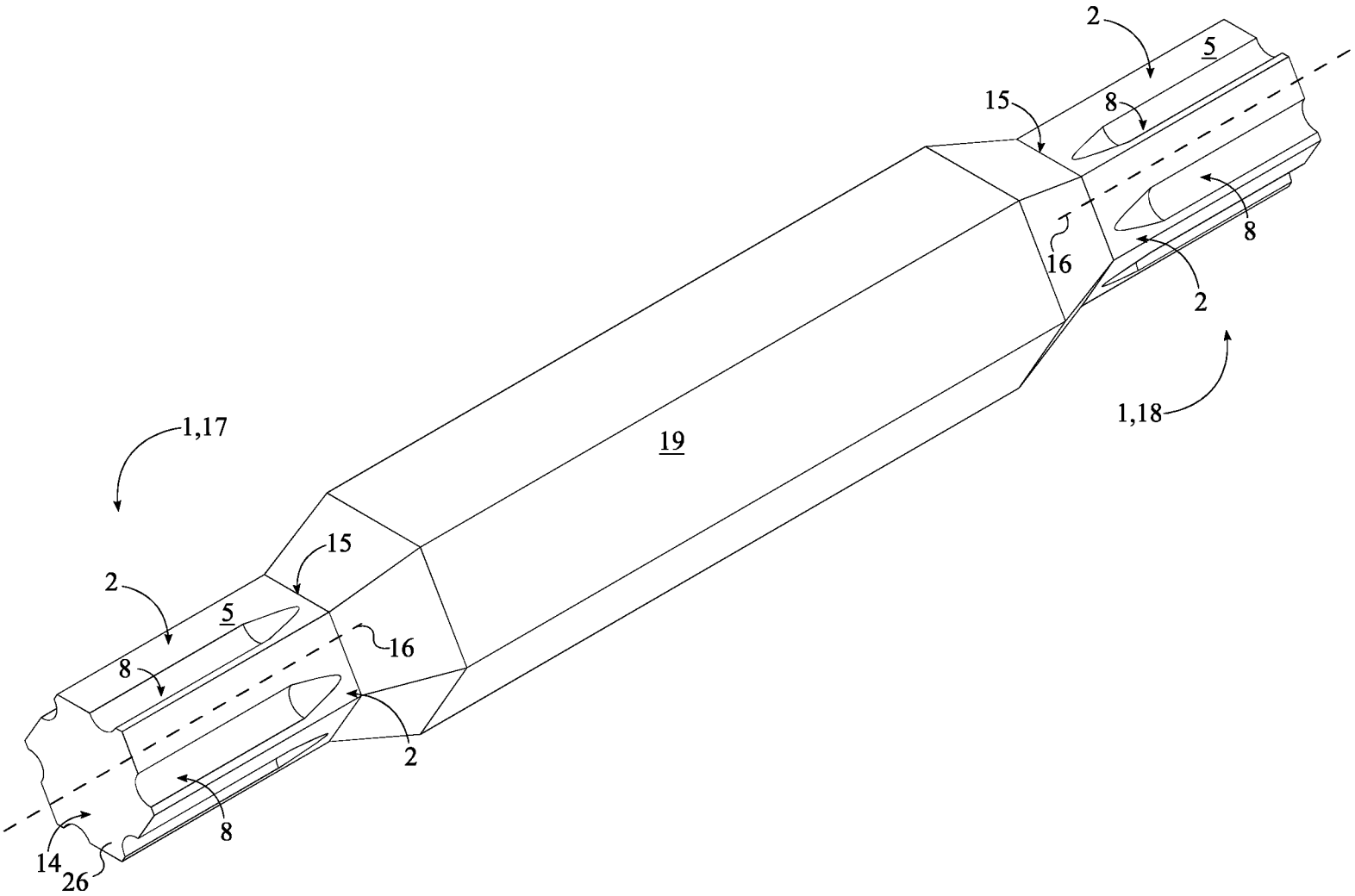
FIG. 2 is a perspective view of an alternative embodiment of the present invention.

In one embodiment, referring to FIG. 2, the present invention is implemented as a dual sided screw bit, thus providing both a clockwise and a counter-clockwise configuration simultaneously in a single tool. In this embodiment, the at least one screw bit body 1 comprises a first screw bit body 17 and a second screw bit body 18. The attachment body 19 preferably has a hexagonal cross-section. The attachment body 19 is centrally positioned around and along the rotation axis 16 of the first screw bit body 17 such that the rotation axis of the attachment body 19 and the rotation axis 16 of the first screw bit body 17 1 are coincidentally aligned. Additionally, the attachment body 19 is connected adjacent to the second base 15 of the first screw bit body 17. The second screw bit body 18 shares the attachment body 19 with the first screw bit body 17. Thus, the second screw bit body 18 1 is concentrically positioned with the first screw bit body 17. Additionally, the second screw bit body 18 is positioned adjacent to the attachment body 19, opposite the first screw bit body 17, similar to traditional double-sided screw bit designs. Similar to the first screw bit body 17, the attachment body 19 is connected to the second base 15 of the second screw bit body 18. The first screw bit body 17 is designed to screw in a socket fastener, the clockwise configuration. For this, referring to FIG. 3, the second distance 22 of the first screw bit body 17 is greater than the first distance 21 of the first screw bit body 17. This positions the additional gripping point of the first screw bit body 17 adjacent to the first lateral edge 3 of the first screw bit body 17. The second screw bit body 18 is designed to unscrew/extract the socket fastener, i.e. the counter-clockwise configuration. Referring to FIG. 4, the first distance 21 of the second screw bit body 18 is greater than the second distance 22 of the second screw bit body 18 1. This positions the additional gripping point of the second screw bit body 18 adjacent to the second lateral edge 4 of the second screw bit body 18.

Figure 5:
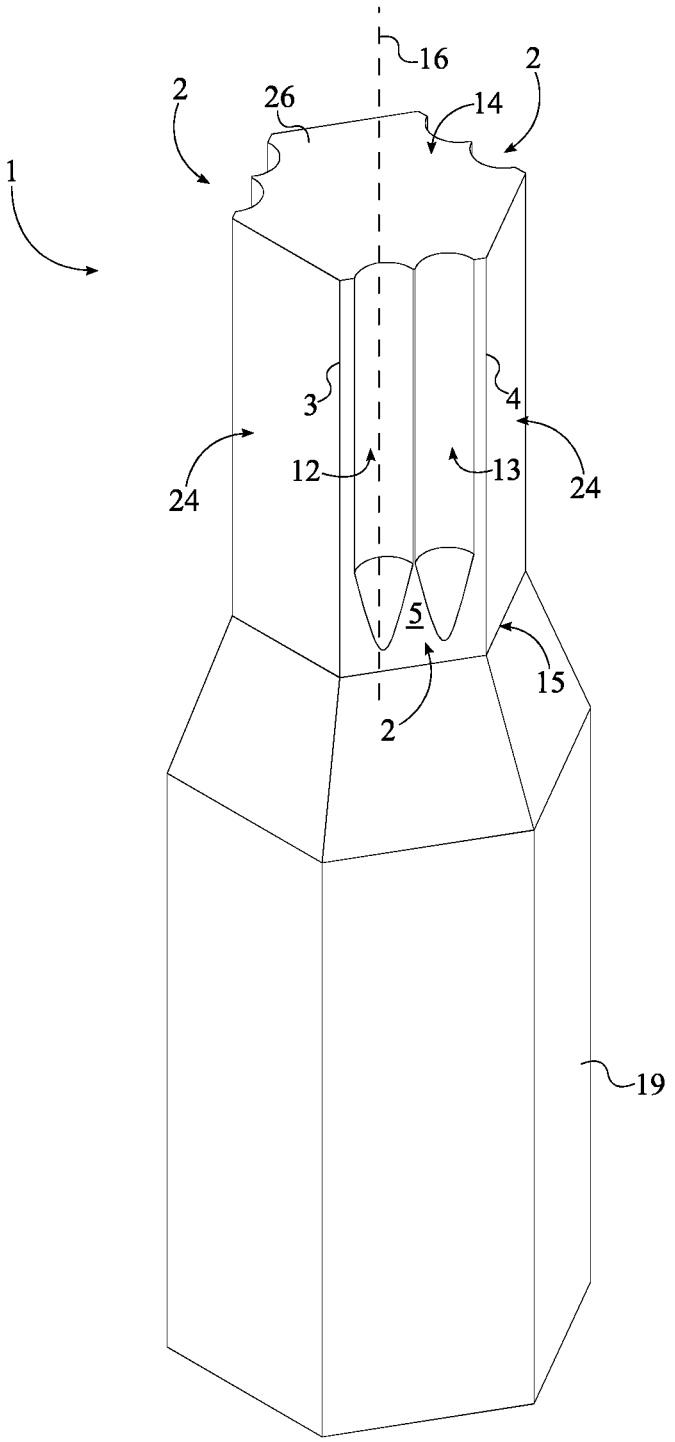
FIG. 5 is a perspective view of an alternative embodiment of the present invention.

In another embodiment of the present invention, referring to FIG. 5, the at least one engagement cavity 8 comprises a first cavity 12 and a second cavity 13. This embodiment is an alternative configuration which yields a clockwise and counter-clockwise configuration. In particular, the first cavity 12 and the second cavity 13 are oriented parallel and offset to each other. The first cavity 12 is positioned adjacent and offset to the first lateral edge 3 and the second cavity 13 is positioned adjacent and offset to the second lateral edge 4. This allows the user to rotate the present invention either in the clockwise or counter-clockwise rotation without removing the present invention from the torque tool while still taking advantage of the additional gripping point(s). In this embodiment, it is preferred that the present invention further comprises the plurality of intermittent sidewalls 24, wherein the plurality of intermittent sidewalls 24 is interspersed amongst the plurality of laterally-bracing sidewalls 2.

Figure 7:
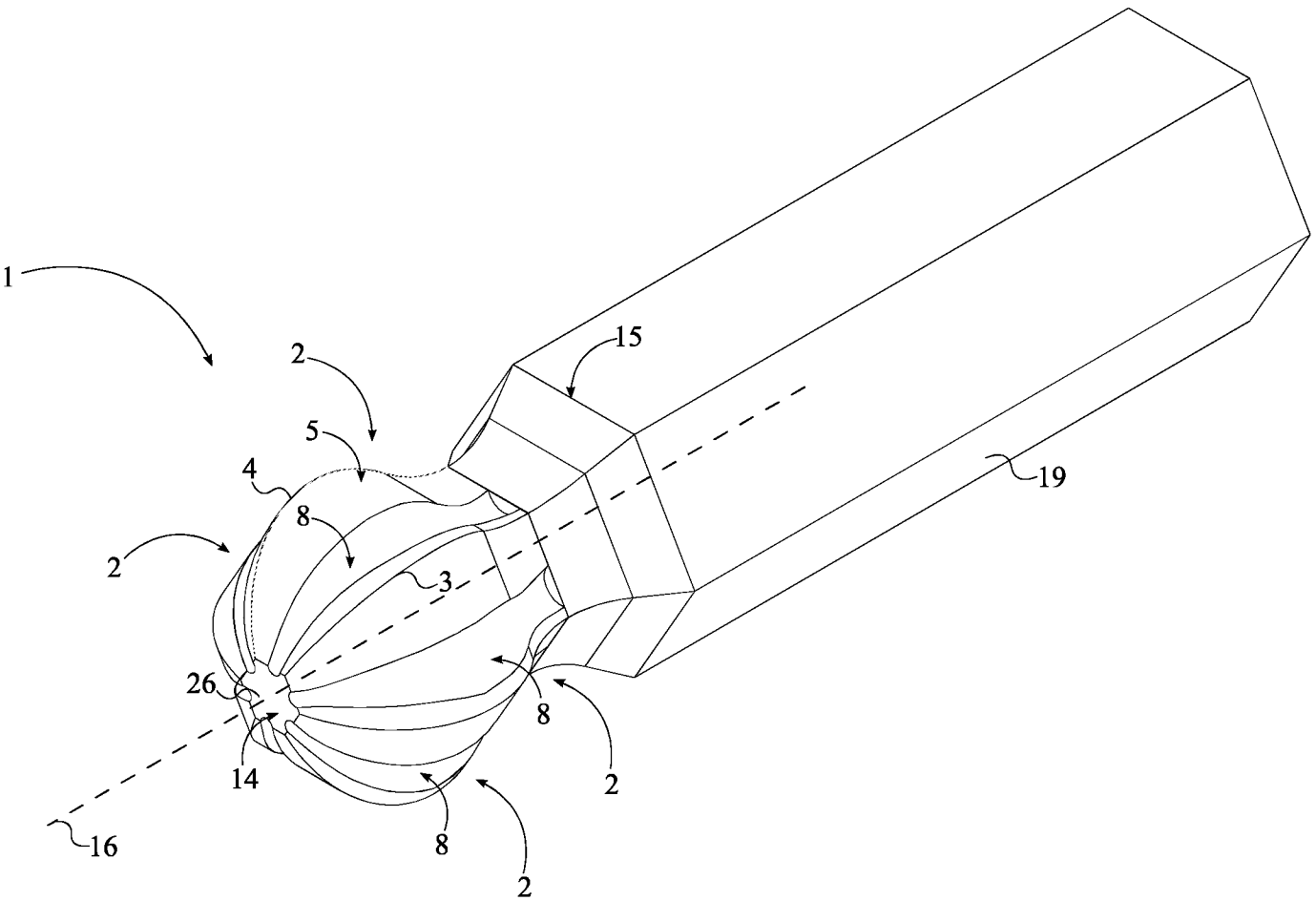
FIG. 7 is a perspective view of an alternative embodiment of the present invention.

Referring to FIG. 7, in an alternative embodiment, the present invention is implemented as a ball-end screw bit. In this embodiment, the bracing surface 5 for each of the plurality of laterally-bracing sidewalls 2 comprises a convex portion 6 and a concave portion 7. The convex portion 6 and the concave portion 7 delineate a curved surface such that, overall, the plurality of laterally-bracing sidewalls 2 forms a ball-like shape. The convex portion 6 is positioned adjacent to the first base 14 such that the convex portion 6 from each of the plurality of laterally-bracing sidewalls 2 forms the body of the ball-like shape. The concave portion 7 is positioned adjacent to the convex portion 6, opposite to the first base 14 such that the concave portion 7 from each of the plurality of laterally-bracing sidewalls 2 further forms the ball-like shape and provides clearance for when the screw bit body 1 is engaged to the socket fastener at an angle. The convex portion 6 and the concave portion 7 are oriented along the rotation axis 16 of the screw bit body 1, and thus the length of the screw bit body 1, to position the ball-like shaped terminally on the screw bit body 1. It is preferred that the curvature, length, and height of the concave portion 7 and the convex portion 6 is identical. Additionally, it is preferred that the engagement cavity 8 extends along the whole length of the convex portion 6 and the concave portion 7. Thus, additional gripping is provided along the screw bit body 1, regardless of the angle between the socket fastener and the screw bit body 1.

Referring to FIG. 10, in one embodiment, the present invention is implemented as a tamper-resistant screw bit. In particular, the present invention further comprises a pin-in security hole 23 which interlocks with a complimentary post within a unique socket fastener. Thus, a set of unique socket fasteners and a unique-key screw bit may be sold, utilized, or manufactured to ensure tamper proof design. This type of interlocking design is used for security reasons, preventing unauthorized personnel from accessing certain socket fasteners. The pin-in security hole 23 is concentrically positioned with the rotation axis 16 of the screw bit body 1. Additionally, the pin-in security hole 23 extends into the screw bit body 1 from the first base 14. The size, depth, and profile of the pin-in security is subject to change to meet the needs and specifications of the user.

Figure 12:
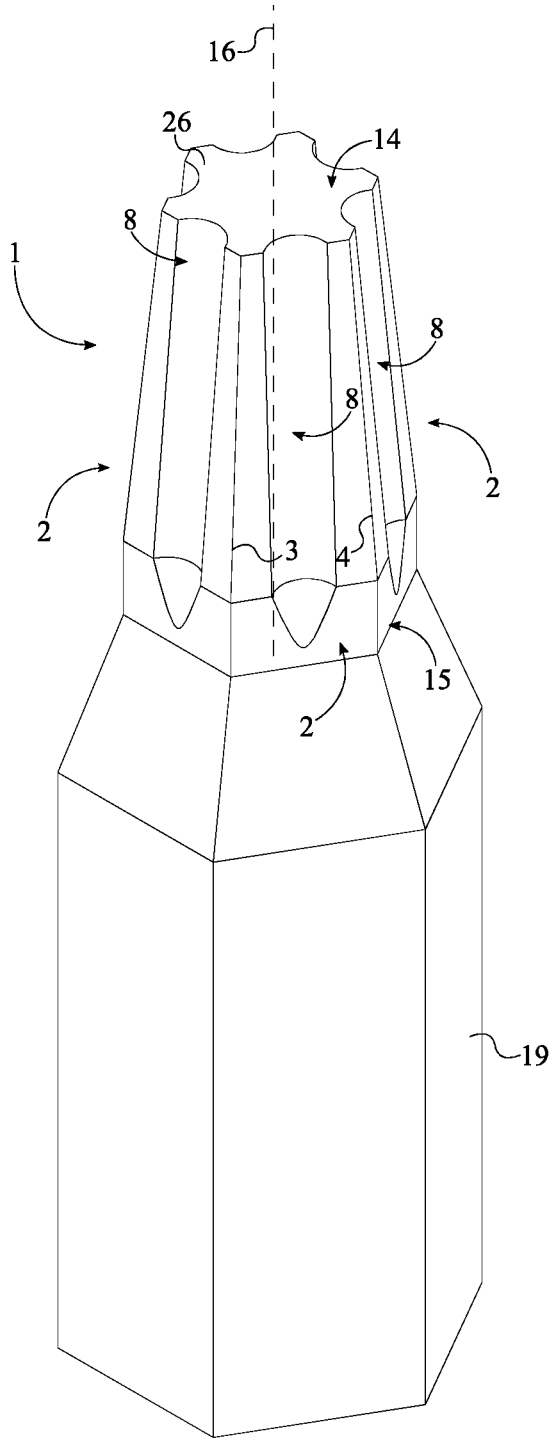
FIG. 12 is a perspective view of an alternative embodiment of the present invention.

In one embodiment, referring to FIG. 11, the present invention includes additional features in order to guide the screw bit body 1 into the socket fastener. In particular, a lateral edge 25 between the first base 14 and each of the plurality of laterally-bracing sidewalls 2 is chamfered which aids the user in interlocking the screw bit body 1 within the socket fastener. Referring to FIG. 12, in another embodiment, the present invention is implemented in a screwdriver design. In this embodiment, the screw bit body 1 is tapered from the second base 15 towards the first base 14, similar to traditional screwdrivers. The degree of tapering is subject to change to meet the needs and requirements of the user.

In other embodiments, the present invention may be implemented in the form of a socket for tightening or loosening of bolts and other similar fasteners. For this, the screw bit body 1 is implemented as a cavity traversing into a cylinder, similar to traditional socket designs.

Although the invention has been explained in relation to its preferred embodiment, it is to be understood that many other possible modifications and variations can be made without departing from the spirit and scope of the invention as hereinafter claimed.

What is claimed is:

1. An anti-slip, multidirectional driver bit comprising:

at least one screw bit body;

an attachment body;

the at least one screw bit body comprising a plurality of laterally-bracing sidewalls, a first base and a second base;

each of the plurality of laterally-bracing sidewalls comprising a first lateral edge, a second lateral edge, a bracing surface and at least one engagement cavity;

the plurality of laterally-bracing sidewalls being radially positioned about a rotation axis of the at least one screw bit body;

the first lateral edge and the second lateral edge being oppositely positioned to each other across the bracing surface;

the at least one engagement cavity extending normal and into the bracing surface;

the at least one engagement cavity extending into the at least one screw bit body from the first base towards the second base;

the at least one engagement cavity being positioned offset from the first lateral edge by a first distance;

the at least one engagement cavity being positioned offset from the second lateral edge by a second distance;

an entire cross-section of the at least one engagement cavity being parallel to the first base and the second base;

the attachment body being centrally positioned around and along the rotation axis;

the attachment body being connected to the second base;

the at least one screw bit body being a spline-type bit body;

the spline-type bit body comprising a plurality of intermittent sidewalls;

the plurality of intermittent sidewalls being radially positioned about the rotation axis;

the plurality of intermittent sidewalls being interspersed amongst the plurality of laterally-bracing sidewalls;

the entire cross-section of the at least one engagement cavity being a partially-circular profile;

the at least one engagement cavity tapering from the first base to the second base such that the partially-circular profile adjacent to the first base is larger than the partially-circular profile adjacent to the second base; and wherein a first intermittent sidewall and a second intermittent sidewall among the plurality of intermittent sidewalls interspersed on a corresponding laterally-bracing sidewall among the plurality of laterally-bracing sidewalls are perpendicularly positioned to each other, wherein a third intermittent sidewall among the plurality of intermittent sidewalls interspersed on the corresponding laterally-bracing sidewall is located in between the at least one engagement cavity of the corresponding laterally-bracing sidewall and the second intermittent sidewall among the plurality of intermittent sidewalls interspersed on the corresponding laterally-bracing sidewall.

2. The anti-slip, multidirectional driver bit as claimed in claim 1 comprising:

a pin-in security hole;

the pin-in security hole being concentrically positioned with the rotation axis of the at least one screw bit body; and the pin-in security hole normally extending into the at least one screw bit body from the first base.

3. The anti-slip, multidirectional driver bit as claimed in claim 1, wherein the first distance is greater than the second distance.

4. The anti-slip, multidirectional driver bit as claimed in claim 1 comprising:

the bracing surface comprising a convex portion and a concave portion;

the convex portion being positioned adjacent to the first base;

the concave portion being positioned adjacent to the convex portion, opposite to the first base; and the convex portion and the concave portion being oriented along the rotation axis of the at least one screw bit body.

5. The anti-slip, multidirectional driver bit as claimed in claim 1 comprising:

the entire cross-section of the at least one engagement cavity comprising a curved portion and a straight portion;

the curved portion being positioned adjacent to the first lateral edge;

the straight portion being positioned adjacent to the curved portion, opposite the first lateral edge; and the straight portion extending from the curved portion to the second lateral edge.

6. The anti-slip, multidirectional driver bit as claimed in claim 1, wherein a lateral edge between the first base and each of the plurality of laterally-bracing sidewalls is chamfered.

7. The anti-slip, multidirectional driver bit as claimed in claim 1 comprising:

the partially-circular profile being concave along a direction from the first lateral edge to the second lateral edge.

8. The anti-slip, multidirectional driver bit as claimed in claim 1 comprising:

the first base comprising a first base surface;

the first base surface and the bracing surface each being flat; and the first base surface and the bracing surface being oriented perpendicular to each other.

9. The anti-slip, multidirectional driver bit as claimed in claim 1 comprising:

an engagement bore; and the engagement bore extending into the attachment body along the rotation axis, opposite the at least one screw bit body.

* * * * *